US012434130B2

(12) United States Patent
Rigby et al.

(10) Patent No.: US 12,434,130 B2
(45) Date of Patent: Oct. 7, 2025

(54) SEPARABLE ASSEMBLY

(71) Applicant: LOVEVERY, INC., Boise, ID (US)

(72) Inventors: Thomas Creason Rigby, Boise, ID (US); Philip J. Fouts, Boise, ID (US)

(73) Assignee: Lovevery, Inc., Boise, ID (US)

( * ) Notice: Subject to any disclaimer, the term of this patent is extended or adjusted under 35 U.S.C. 154(b) by 545 days.

(21) Appl. No.: 17/996,724

(22) PCT Filed: Jun. 8, 2020

(86) PCT No.: PCT/US2020/036679
§ 371 (c)(1),
(2) Date: Oct. 20, 2022

(87) PCT Pub. No.: WO2021/251947
PCT Pub. Date: Dec. 16, 2021

(65) Prior Publication Data

US 2023/0211229 A1 Jul. 6, 2023

(51) Int. Cl.
*A63F 3/00* (2006.01)

(52) U.S. Cl.
CPC ..... *A63F 3/00533* (2013.01); *A63F 3/00094* (2013.01); *A63F 3/00261* (2013.01);
(Continued)

(58) Field of Classification Search
CPC ..... A63F 3/00094; A63F 3/00261; A63F 3/00533; A63F 2003/0041;
(Continued)

(56) References Cited

U.S. PATENT DOCUMENTS 2,100,421 A 11/1937 Wupper
3,926,437 A * 12/1975 Moe ..... A63F 3/02 273/289

(Continued)

FOREIGN PATENT DOCUMENTS

WO WO 2019/006112 1/2019

OTHER PUBLICATIONS

Extended European Search Report in European Appln No. 20939793.4, dated Jun. 20, 2023, 5 pages.

(Continued)

*Primary Examiner* — William H McCulloch, Jr.
(74) *Attorney, Agent, or Firm* — Fish & Richardson P.C.

(57) ABSTRACT

A separable assembly includes a cellulose member having a side surface and an end face forming an edge with the side surface. The cellulose member defines an elongated sliding track that extends from an end opening at the end face and has a T-shaped transverse cross-section. The cellulose member defines a side opening along the sliding track at the side surface of the cellulose member. The sliding track further defines a detent recess spaced from the end surface and extending into the cellulose member. The separable assembly includes a rigid plastic member having an edge configured to be received within the end opening of the cellulose member and slid along the sliding track with the plastic member extending through the side opening. The plastic member includes a detent protrusion configured to engage the detent recess.

20 Claims, 10 Drawing Sheets

(52) U.S. Cl.
CPC ..... *A63F 2003/0041* (2013.01); *A63F 2003/00457* (2013.01); *A63F 2003/00558* (2013.01)

(58) Field of Classification Search
CPC .. A63F 2003/00457; A63F 2003/00542; A63F 2003/00552; A63F 2003/00558
See application file for complete search history.

(56) References Cited

U.S. PATENT DOCUMENTS 4,243,227 A * 1/1981 Strongin ..... A63F 9/02 273/357
4,243,277 A 1/1981 Strongin
4,552,362 A 11/1985 Oake
4,739,886 A 4/1988 Seaberg
4,925,146 A 5/1990 Hegarty
5,427,379 A 6/1995 Lee
5,454,745 A 10/1995 Speilberger
5,503,400 A * 4/1996 Silva ..... A63F 3/02 273/288
6,345,822 B1 * 2/2002 Reynolds ..... A63F 3/00261 273/287
6,428,003 B1 8/2002 Fondin et al.
6,655,687 B2 12/2003 Sanchez-Seco
6,752,299 B2 6/2004 Shetler et al.
6,878,059 B2 * 4/2005 Boeru ..... A63F 9/083 463/9
7,544,097 B2 * 6/2009 Hong ..... H01R 13/701 439/607.22
7,568,928 B2 * 8/2009 Hou ..... H01R 13/2442 439/188
7,789,391 B2 * 9/2010 Boeru ..... A63F 3/00094 463/9
7,810,814 B1 10/2010 Chapman et al.
8,100,722 B2 1/2012 Hu et al.
8,112,894 B2 2/2012 Caswell
8,113,827 B2 2/2012 Farzin-Nia et al.
8,366,530 B1 * 2/2013 Boeru ..... A63F 9/083 463/9
8,631,619 B2 1/2014 Clayton et al.
9,275,260 B2 * 3/2016 Soo ..... H01R 12/721
9,640,911 B2 5/2017 Chen et al.
10,478,711 B2 * 11/2019 Stoll ..... A63F 1/00
11,331,562 B2 * 5/2022 Titelius ..... A63F 3/00094
11,439,893 B2 * 9/2022 Shoaff ..... F41B 11/646
11,654,376 B2 * 5/2023 Rigby ..... A63H 33/00 446/75
12,220,646 B1 * 2/2025 Zhuang ..... A63F 3/00006
2002/0175472 A1 * 11/2002 Boeru ..... A63F 9/083 273/153 S
2005/0164758 A1 * 7/2005 Boeru ..... A63F 3/00094 463/9
2006/0175755 A1 * 8/2006 Benedict, III ..... A63F 3/0423 273/271
2006/0273509 A1 * 12/2006 Davis ..... A63F 3/00533 273/242
2007/0278920 A1 12/2007 Chen
2010/0263171 A1 10/2010 Paik
2014/0159309 A1 6/2014 Jiang
2015/0014930 A1 1/2015 Summerville et al.
2015/0048730 A1 2/2015 Lowe et al.
2018/0056153 A1 3/2018 Calandruccio
2018/0264351 A1 * 9/2018 Stoll ..... A63F 1/18
2021/0093944 A1 * 4/2021 Titelius ..... A63F 11/0002
2021/0093945 A1 * 4/2021 Shoaff ..... A63F 9/0252
2023/0211229 A1 * 7/2023 Rigby ..... A63F 3/00094 273/271

OTHER PUBLICATIONS

International Search Report and Written Opinion in International Appln. No. PCT/US2020/036679, mailed on Sep. 9, 2020, 10 pages.
International Preliminary Report on Patentability in International Appln. No. PCT/US2020/036679, mailed on Dec. 22, 2022, 7 pages.

* cited by examiner

SEPARABLE ASSEMBLY

CROSS-REFERENCE TO RELATED APPLICATIONS

This application is a National Stage Application under 35 U.S.C. § 371 and claims the benefit of International Application No. PCT/US2020/036679, filed Aug. 6, 2020. The entire contents of which are incorporated herein by reference.

TECHNICAL FIELD

This invention generally relates to separable assemblies, and more particularly to separable assemblies having detent interfaces.

BACKGROUND

Board games and other types of toys often include separable assemblies that rely on interfaces to connect two or more components. Games and toys intended to be used by children, specifically children under three years old, are generally required to comply with restrictions in regards to component size that may present a choking, aspiration, or ingestion hazard. Improvements in the design and safety of component interfaces of board games and toys are continually sought.

SUMMARY

One aspect of the present invention features a separable assembly including a cellulose member having a side surface and an end face forming an edge with the side surface. The cellulose member defines an elongated sliding track therein, the elongated sliding track extending from an end opening at the end face and being of T-shaped transverse cross-section. The cellulose member defines a side opening along the sliding track at the side surface of the cellulose member. The sliding track further defines a detent recess spaced from the end face and extending into the cellulose member. The separable assembly includes a rigid plastic member having an edge configured to be received within the end opening of the cellulose member and slid along the sliding track with the plastic member extending through the side opening. The plastic member includes a detent protrusion configured to engage the detent recess to retain the plastic member at an assembled position along the sliding track. The plastic member includes a spring bridge extending between two fixed bridge ends spaced apart along the edge, with the detent protrusion extending from the spring bridge at a position between the two bridge ends. The detent protrusion and detent recess aref configured such that sufficient force applied to move the plastic member along the sliding track from the assembled position toward the end opening will resiliently deflect the spring bridge to withdraw the detent protrusion from the detent recess.

In some embodiments, the cellulose member is a leg supporting the rigid plastic member when the separable assembly is assembled. In some examples, the side opening has an overall width that is about equal to the width of the edge of the plastic member. In some cases, the sliding track is a recessed slot defined by the cellulose member. In some arrangements, the elongated sliding track extends from the end opening at the end face to a closed end. In some embodiments, the closed end is curved. In some embodiments, the detent recess has a radius of about 1 millimeters (mm) to 7 mm.

In some examples, the plastic member is a board. In some embodiments, the plastic member has a hardness that is greater than the hardness of the cellulose member. In some cases, the plastic member has a height that is greater than the height of the cellulose member. In some examples, the radius of the detent protrusion is about equal to the radius of the detent recess. In some embodiments, the detent protrusion is a partially hemispherical protrusion having a planar surface opposite the detent recess, the planar surface configured to contact a surface of the detent recess when engaging the detent recess. In some arrangements, the detent protrusion has a radius of about 1 millimeters (mm) to 7 mm.

In some embodiments, the detent protrusion is a hemispherical protrusion. In some embodiments, the spring bridge has a planar surface opposite the detent recess, the planar surface being coplanar with surfaces of the plastic member adjacent to the bridge ends. In some embodiments, the spring bridge has a surface opposite the detent recess that is planar along an entire length of the spring bridge between the two bridge ends. In some examples, the spring bridge defines a pair of opposing slots extending along the length of the spring bridge between the two bridge ends. In some cases, the width of each opposing slot is less than the width of the surface of the spring bridge. In some embodiments, the deflection of the detent protrusion during disassembly of the separable assembly bows the spring bridge out of its plane. In some arrangements, the spring bridge has a length that is less than the length of the edge of the plastic member.

Various embodiments of the present disclosure relate to separable assemblies preferably intended for use by infants of age three and under. More specifically, embodiments include separable assemblies featuring detent interfaces that do not pose a choking, aspiration, or ingestion hazard to children under three years old during use. The separable assemblies of the present disclosure are therefore designed to be approved for use by children under three years of age e.g., in the United States and European Union (per the 16 Code of Federal Regulations (C.F.R.) Part 1501 and The Toy Safety Directive 2009/48/EC, respectively). For example, the separable assembly featured in certain embodiments can be manufactured without conventional interface components that may produce small parts (as defined by 16 C.F.R. Part 1501) during normal use. Furthermore, certain embodiments provide separable assemblies that can be assembled (and disassembled) without special tools or fasteners. Moreover, certain embodiments provide separable assemblies that are capable of withstanding foreseeable use, damage, or abuse by children, such as impact of the separable assembly onto an impact medium (e.g., a ground surface) while still maintaining the connection of the separable assembly connected at the interface. Still further embodiments provide separable assemblies having an interface connection that applies sufficient mechanical stress on the connecting surface of the interface member (e.g., a cellulose member) such that the cyclic application of mechanical stress can minimize or prevent the deformation of the connecting surface of the interface member.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
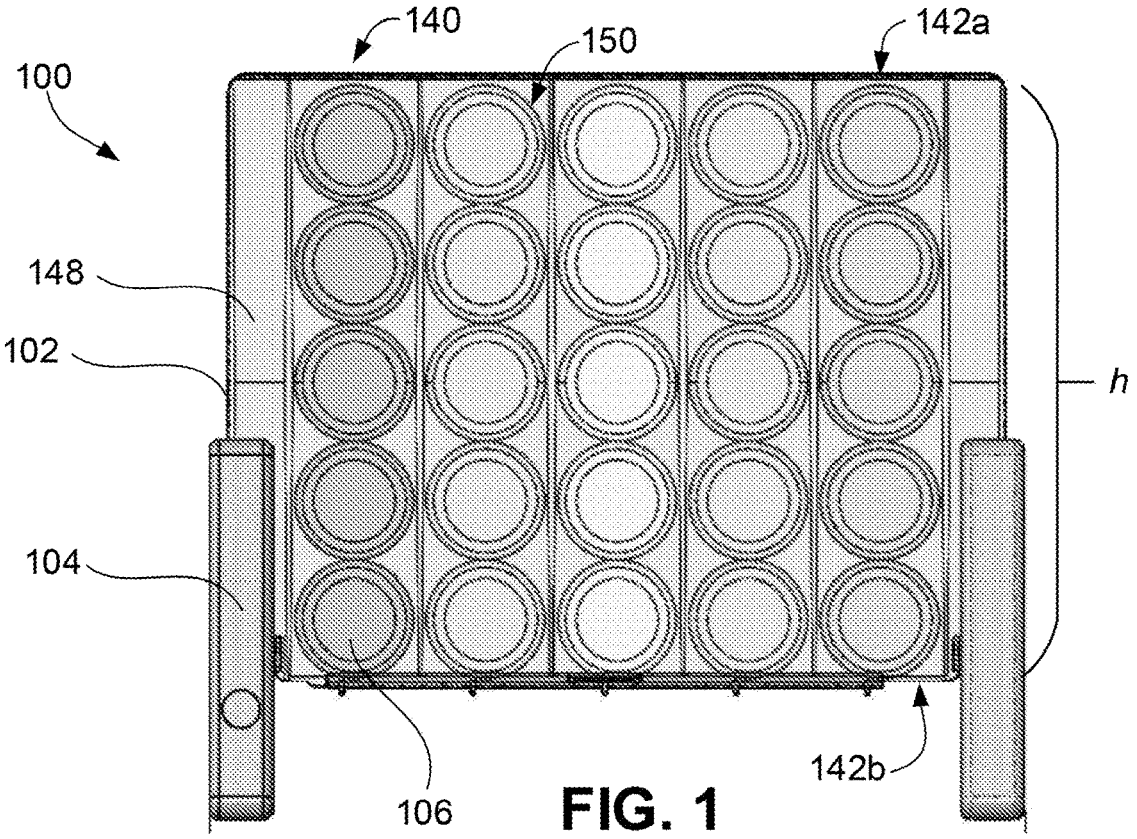
FIG. 1 is a front view of a separable assembly.
Figure 2:
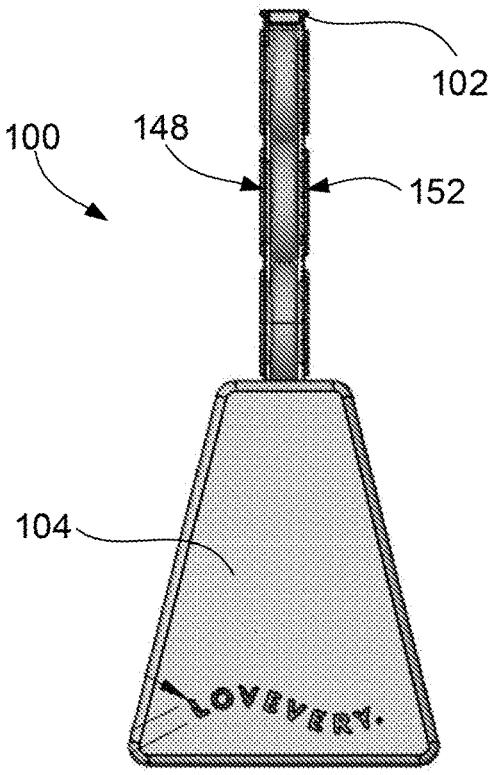
FIG. 2 is a side view of the separable assembly of FIG. 1.

FIGS. 1 and 2 illustrate a separable assembly 100 in an assembled state. The separable assembly 100 can be a toy (e.g., a game board). Separable assembly 100 includes a plastic member 102 and two cellulose members 104. The plastic member 102 can be a board. The cellulose members 104 can be legs that support the plastic member 102, when the separable assembly 100 is assembled. In an assembled state, the plastic member 102 is received by the two cellulose members 104. The plastic member 102 has a first wall 148 defining a first plurality of openings 150 and a second wall 152 defining a second plurality of openings. The second plurality of openings are aligned with the first plurality of openings 150. The plastic member 102 can include a plurality of channels 140 that are formed in between the first wall and the second wall. The plurality of channels 140 extend from a first end 142*a* to a second end 142*b* and along the height h of the plastic member 102. The separable assembly 100 includes five channels 140. In some examples, the separable assembly 100 can include about 4 to about 7 channels 140. The plurality of channels 140 receive a plurality of disks 106, which once received, are visible through the first plurality of openings 150 and second plurality of openings. The diameter of the disks 106 is about equal to the diameter of the first plurality of openings 150 and second plurality of openings. The separable assembly 100 includes 25 disks 106. In some embodiments, the separable assembly 100 can include about 16 to about 49 disks 106. The plurality of channels 140 can be vertical channels, as shown in FIG. 1. Alternatively, the plurality of channels 140 can have curved portions such that one or more channels interconnect.

Figure 3:
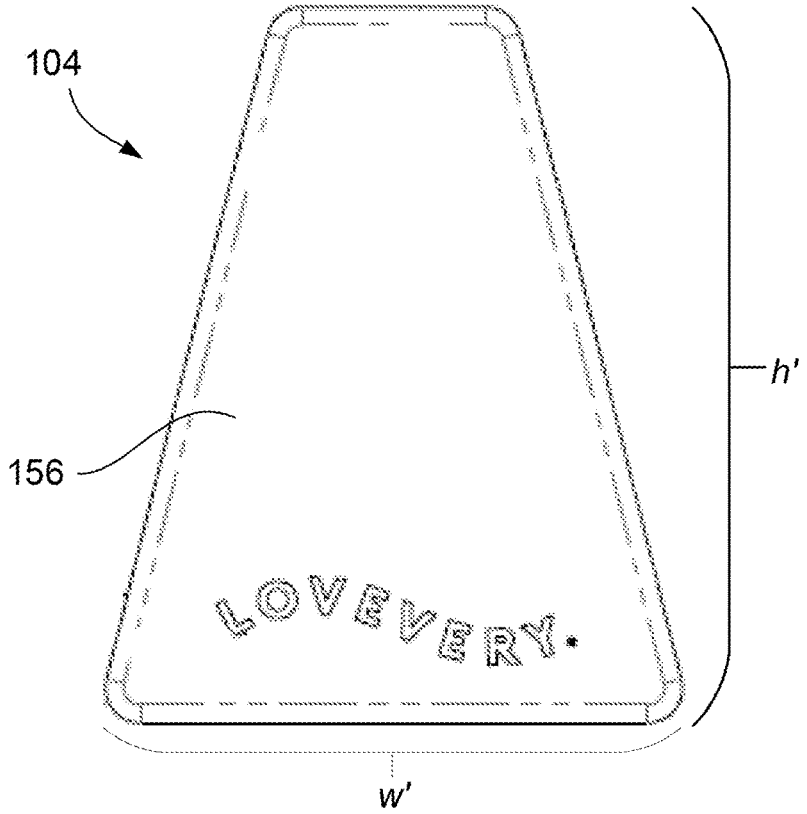
FIG. 3 is a side view of an outer surface of a cellulose member of the separable assembly of FIG. 1.
Figure 4:
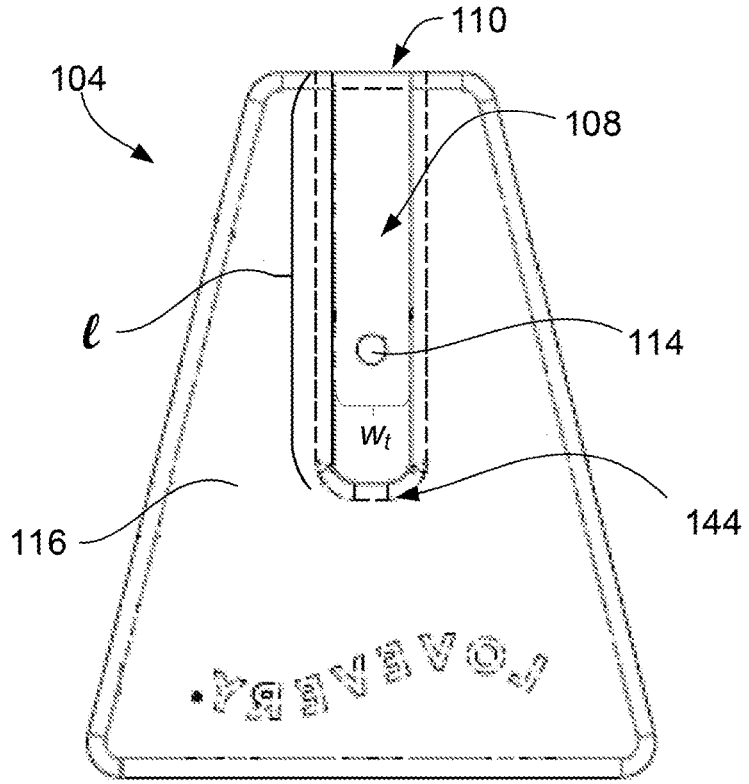
FIG. 4 is a side view of an inner surface of the cellulose member of FIG. 3.
Figure 5:
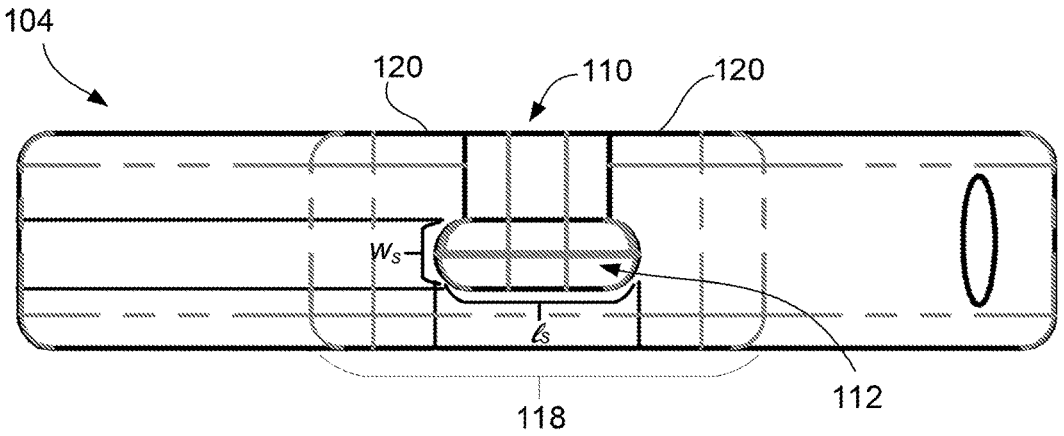
FIG. 5 is a top view of the cellulose member of FIG. 3.

Referring to FIGS. 3-5, the cellulose members 104 have an outer surface 156, an inner side surface 116, and an end face 118. FIG. 3 shows a front view of the outer side surface 156, which does not come in contact with the plastic member 102 when the separable assembly 100 is assembled. FIG. 4 shows a front view of the inner side surface 116, which comes in contact with the plastic member 102 when assembled. FIG. 5 shows a top view of the cellulose member 104. As shown in FIG. 5, the cellulose member 104 has an end face 118 that forms an edge 120 with the inner side surface 116. Referring back to FIG. 4, the cellulose member 102 defines an elongated sliding track 108. The sliding track can be a recessed slot defined by the cellulose member. The sliding track 108 extends from an end opening 110 at the end face 118 to a closed end 144. The sliding track 108 further defines a detent recess 114 spaced from the end face 118 and extending into the cellulose member 104. The detent recess 114 has a circular shape. The detent recess 114 can be a through hole that extends through the cellulose member 104 from the inner side surface 116 and to the outer side surface 156. In other examples, the detent recess 114 can be a blind hole that only partially extends into the cellulose member 104 from the inner side surface 116 and does not extend entirely through to the outer side surface 156. Referring back to FIG. 5, the cellulose member 104 defines a side opening 112 along the sliding track 108 at the inner side surface 116 of the cellulose member 104. Thus, the sliding track 108 has a T-shaped transverse cross-section. The side opening 112 has an overall width that is about equal to the width of the edge 124 of the plastic member 102.

The cellulose member 104 has a substantially trapezoidal shape. The trapezoidal shape provides a stable base that supports the plastic member 102 when in an assembled state. In alternative embodiments, the cellulose member 104 can have a rectangular, square, triangular, or any other suitable shape. The cellulose member 104 typically has a total height h' of about 120 mm. Furthermore, the cellulose member 104 typically has a total width w' of about [97 mm]. The side opening 112 typically has a total width $l_s$ of about 19 mm and a total width $w_s$ of about 6 mm. The sliding track 108 typically has a total width $w_t$ of about 13.5 mm and a total length l of about 70 mm. Moreover, detent recess 114 is spaced apart from the end face 118 a total distance of about 50 mm and from the closed end 144 of sliding track 108 a total distance of about 20 mm. Detent recess 114 has a diameter of about 5 mm.

The cellulose member 104 is typically made of one or more suitable materials that provide durability (e.g., wood). Example wooden materials from which the cellulose member 104 is typically made include beech wood. The cellulose member 104 is typically manufactured primarily via cutting, bending, molding, and/or sanding of the wooden materials.

Figure 6:
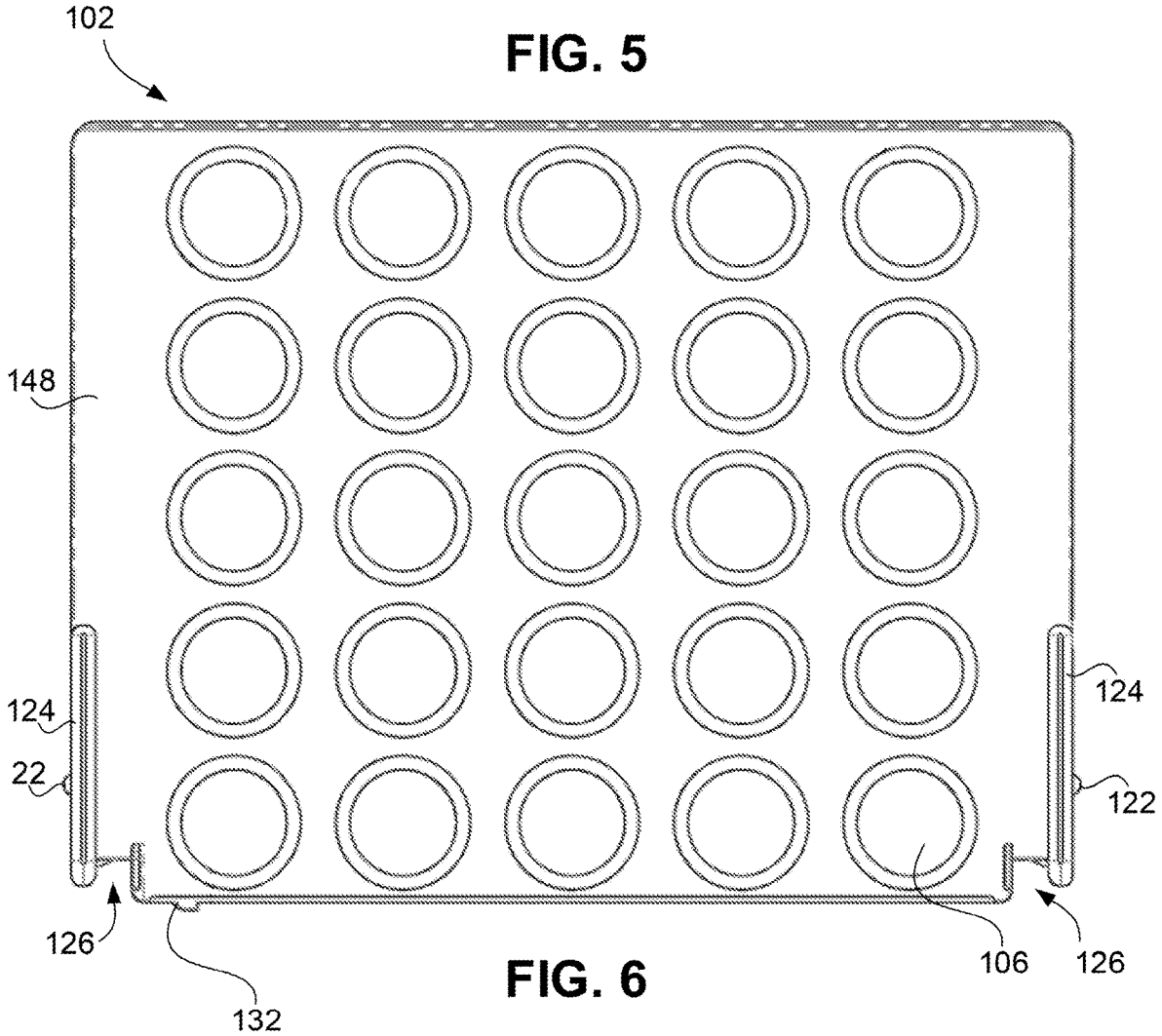
FIG. 6 is a front view of a rigid plastic member of the separable assembly of FIG. 1.
Figure 7:
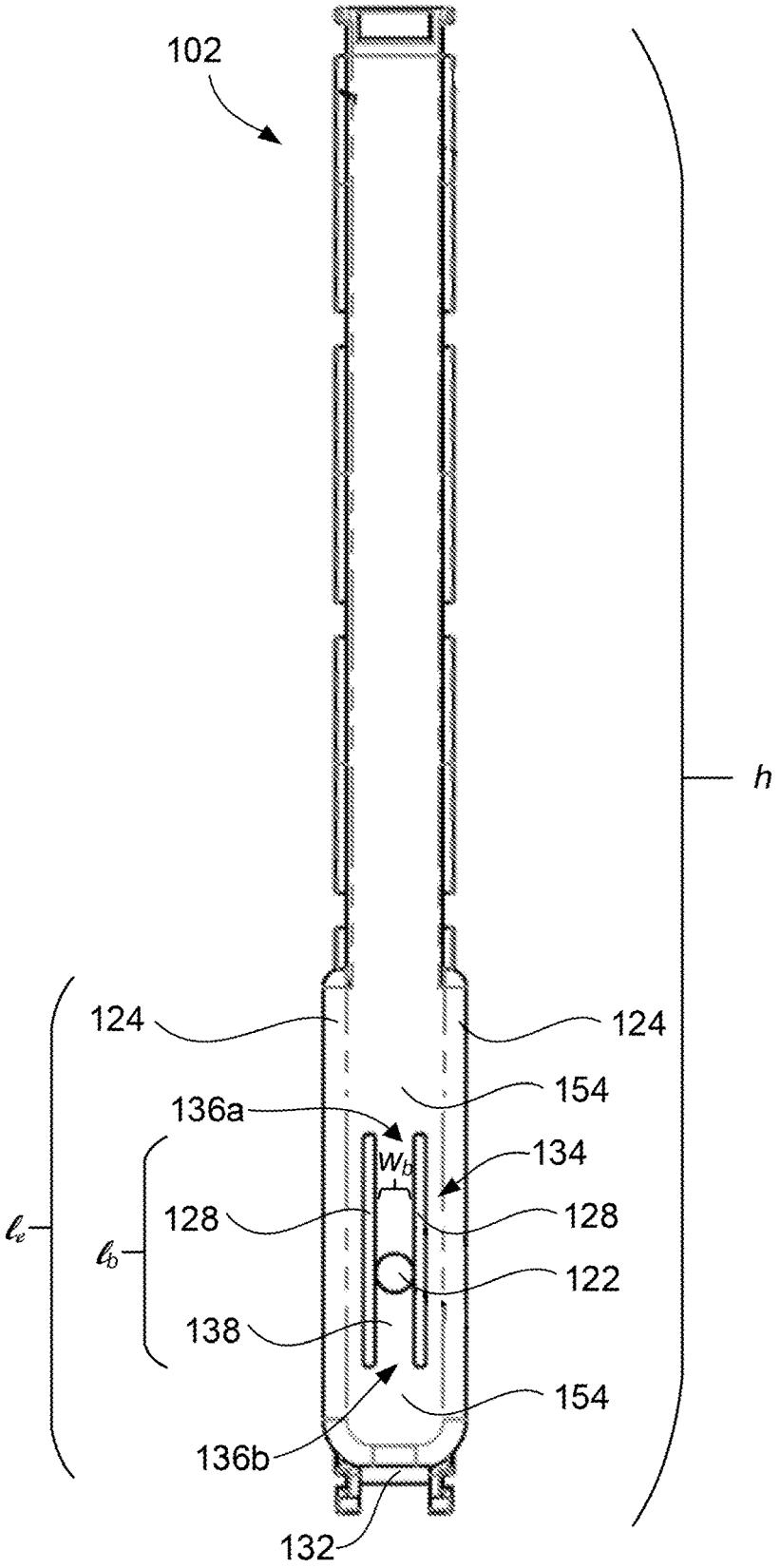
FIG. 7 is a side view of the rigid plastic member of FIG. 6.
Figure 8:
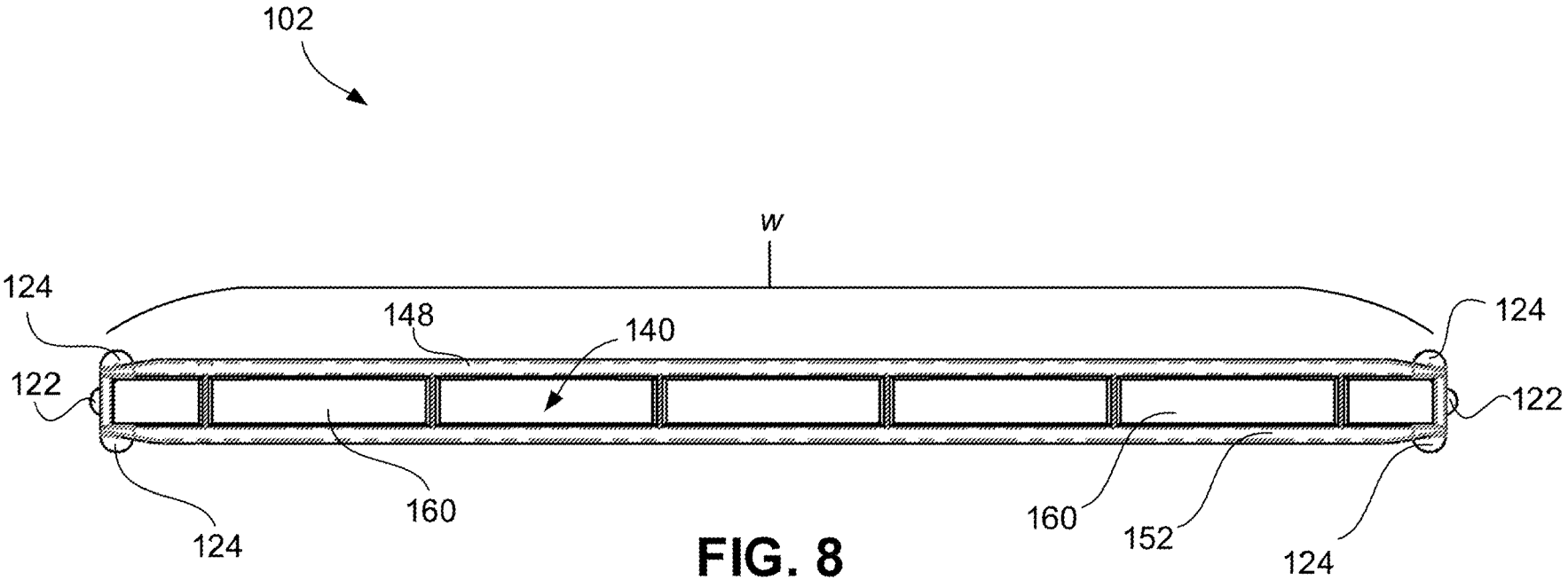
FIG. 8 is a top view of the rigid plastic member of FIG. 6.

Referring to FIGS. 6-8, plastic member 102 has a substantially rectangular shape having an edge 124 at opposing sides. Edge 124 is configured to be received within the end opening 110 of the cellulose member 102. Edge 124 is configured to be slid along the sliding track 108 with the plastic member 102 extending through the side opening 112. The plastic member 102 further includes a detent protrusion 122 that is configured to engage the detent recess 114 to retain the plastic member 102 at an assembled position along the sliding track 108. Detent protrusion 122 is a hemispherical protrusion. In some examples, detent protrusion 122 can be a partially hemispherical protrusion. Plastic member 102 further defines two recessed corners 126 extending from an end of edge 124 to a bottom surface of the plastic member 102. Recessed corners 126 are received by a surface of the closed end 144 of sliding track 108 when the separable assembly 100 is assembled. Closed end 144 is curved in shape, which allows for a tight fit between the recessed corners 126 and the closed end 144 as well as the edges 124 and the closed end 144. Plastic member 102 further includes a sliding bar 132 extending between recessed corners 126 and connecting the first wall 148 and the second wall. Sliding bar 132 that is configured to be slid along the bottom face of the plastic member 102 from a first position in which it allows disks 106 to be ejected from the plurality of channels 140 to a second position in which it prevents disks 106 from being ejected from the plurality of channels 140 when loaded. FIG. 6 shows the sliding bar 132 in the second position. Plastic member 102 further defines a plurality of openings 160 between the first wall 148 and the second wall 152. The plurality of openings 160 align with the plurality of channels 140 and allow the introduction sliding of disks 106 along the plurality of channels 140.

Referring to FIG. 7, the plastic member 102 includes a spring bridge 134 extending between a first fixed bridge end 136*a* and a second fixed bridge end 136*b*. The first fixed bridge end 136*a* and a second fixed bridge end 136*b* are spaced apart along the edge 124 of the plastic member 102. The spring bridge 134 defines a pair of opposing slots 128 extending along the edge 124 of plastic member 102 between the first fixed bridge end 136*a* and a second fixed bridge end 136*b*. The pair of slots 128 allow the spring bridge to have sufficient resiliency to be deflected upon an application of force. The spring bridge 134 has a planar surface 138 opposite the detent recess 114, when assembled, such that the planar surface 138 is coplanar with surfaces 154 of the plastic member 102 adjacent the first fixed bridge end 136*a* and a second fixed bridge end 136*b*. The spring bridge 134 has a surface opposite the detent recess 114, when assembled, that is planar along an entire length of the spring bridge 134 between the first fixed bridge end 136*a* and a second fixed bridge end 136*b*. The width of each slot 128 is less than the width of the planar surface 138 of the spring bridge 134. The detent protrusion 122 extends from the spring bridge 134 at a position between the first fixed bridge end 136*a* and a second fixed bridge end 136*b*.

Figure 9:
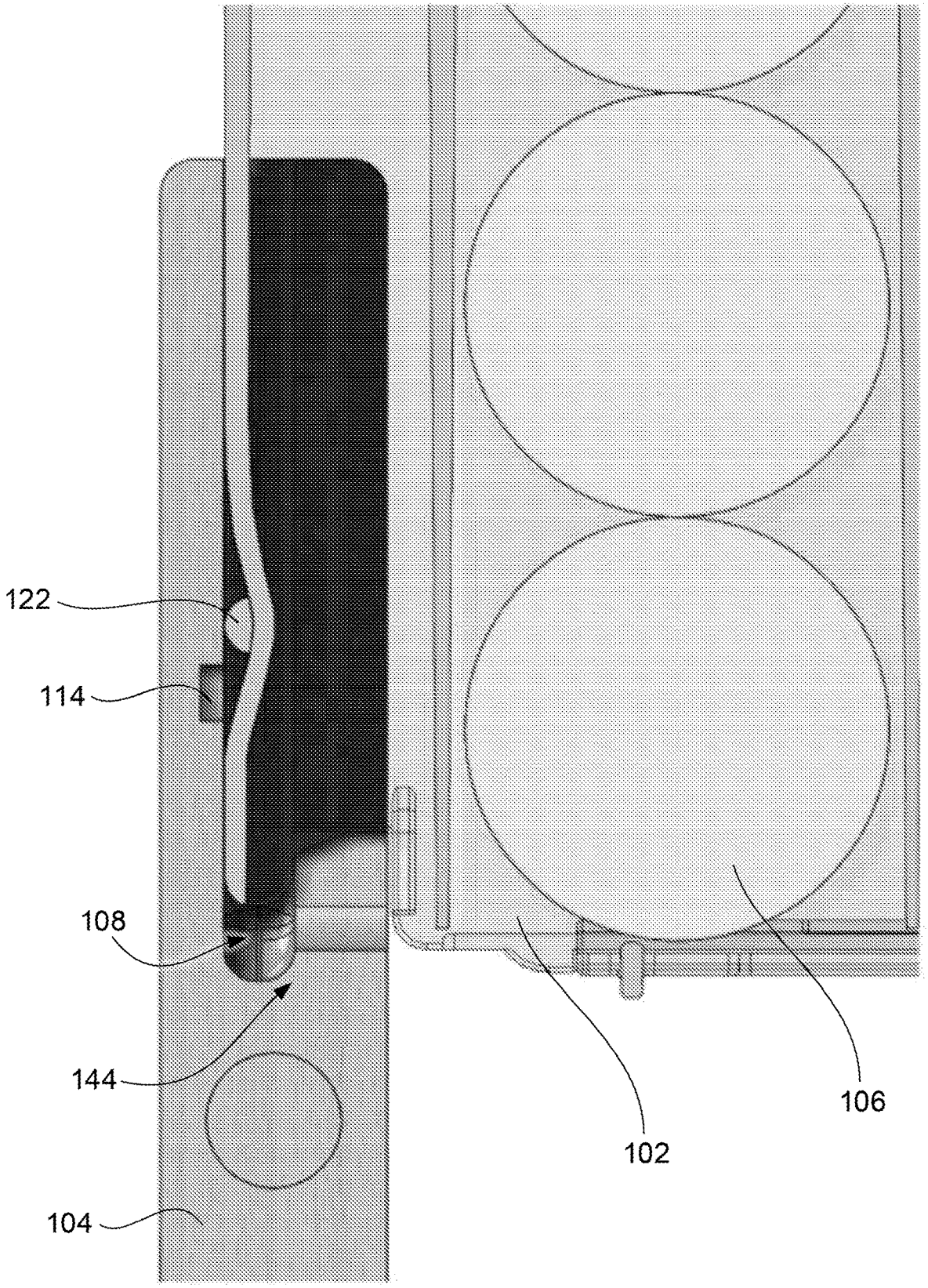
FIG. 9 is a longitudinal, cross-sectional view of the separable assembly of FIG. 1 before the rigid plastic member engages with cellulose member.

Referring to FIGS. 9-12, the detent protrusion 122 and detent recess 114 are configured such that sufficient force applied to move the plastic member 102 along the sliding track 108 from the assembled position toward the end opening 110 will resiliently deflect the spring bridge 134 to withdraw the detent protrusion 122 from the detent recess 114. The deflection of the detent protrusion 122 during disassembly of the separable assembly 100 bows the spring bridge 134 out of its plane, as shown in FIG. 9. In some examples, the deflection of the detent protrusion 122 during disassembly of the separable assembly 100 bows the spring bridge 134 out of its plane at an angle of less than about 45 degrees with respect to the surface of the sliding track 108. Detent recess 114 partially extends into the cellulose member 104. Detent recess 114 has a substantially square shape. In some examples, detent recess 114 has a curved shape or any other suitable shape that is engageable by the detent protrusion.

Figure 10:
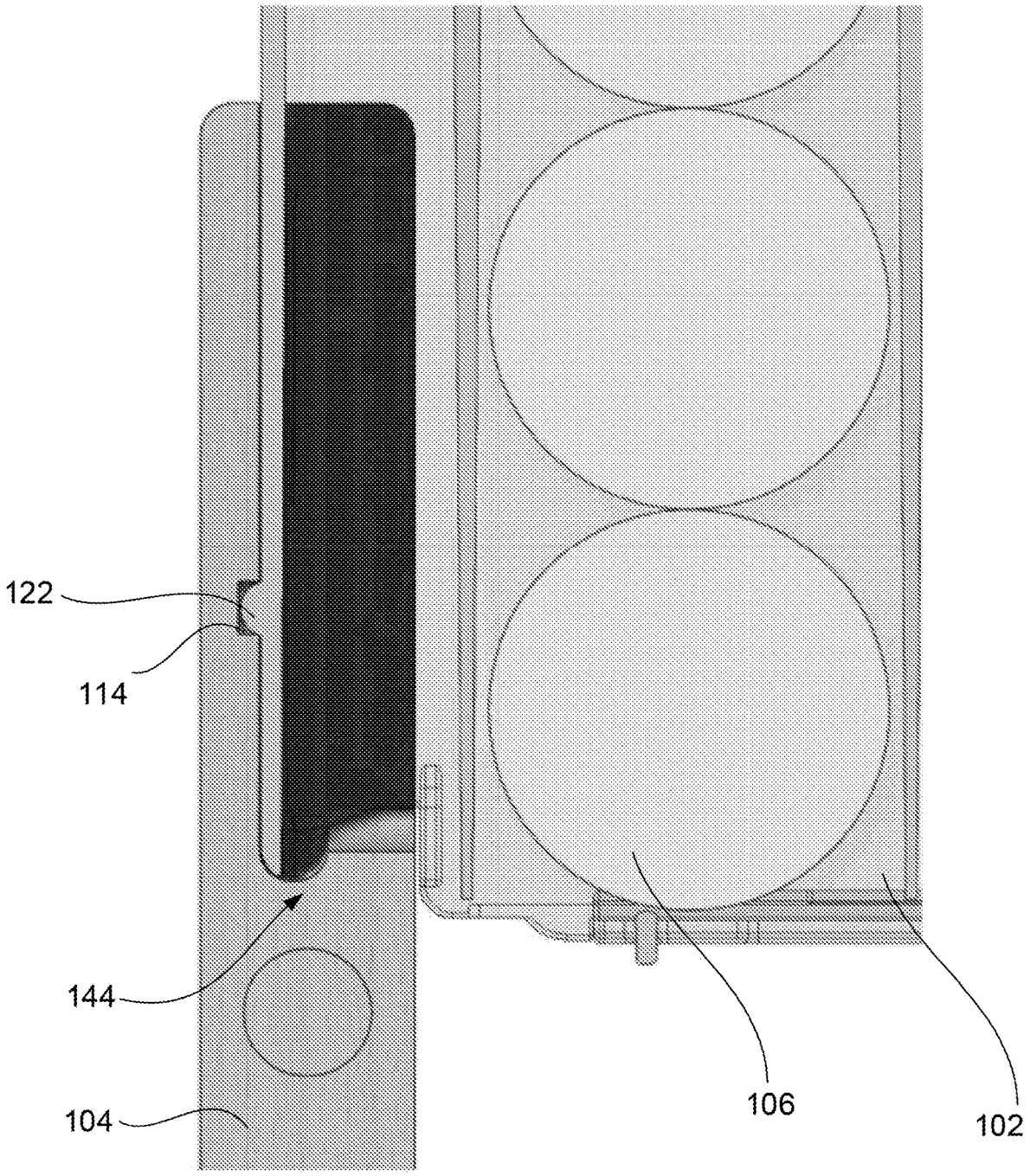
FIG. 10 is a longitudinal, cross-sectional view of the separable assembly of FIG. 1 after the rigid plastic member engages with cellulose member.
Figure 11:
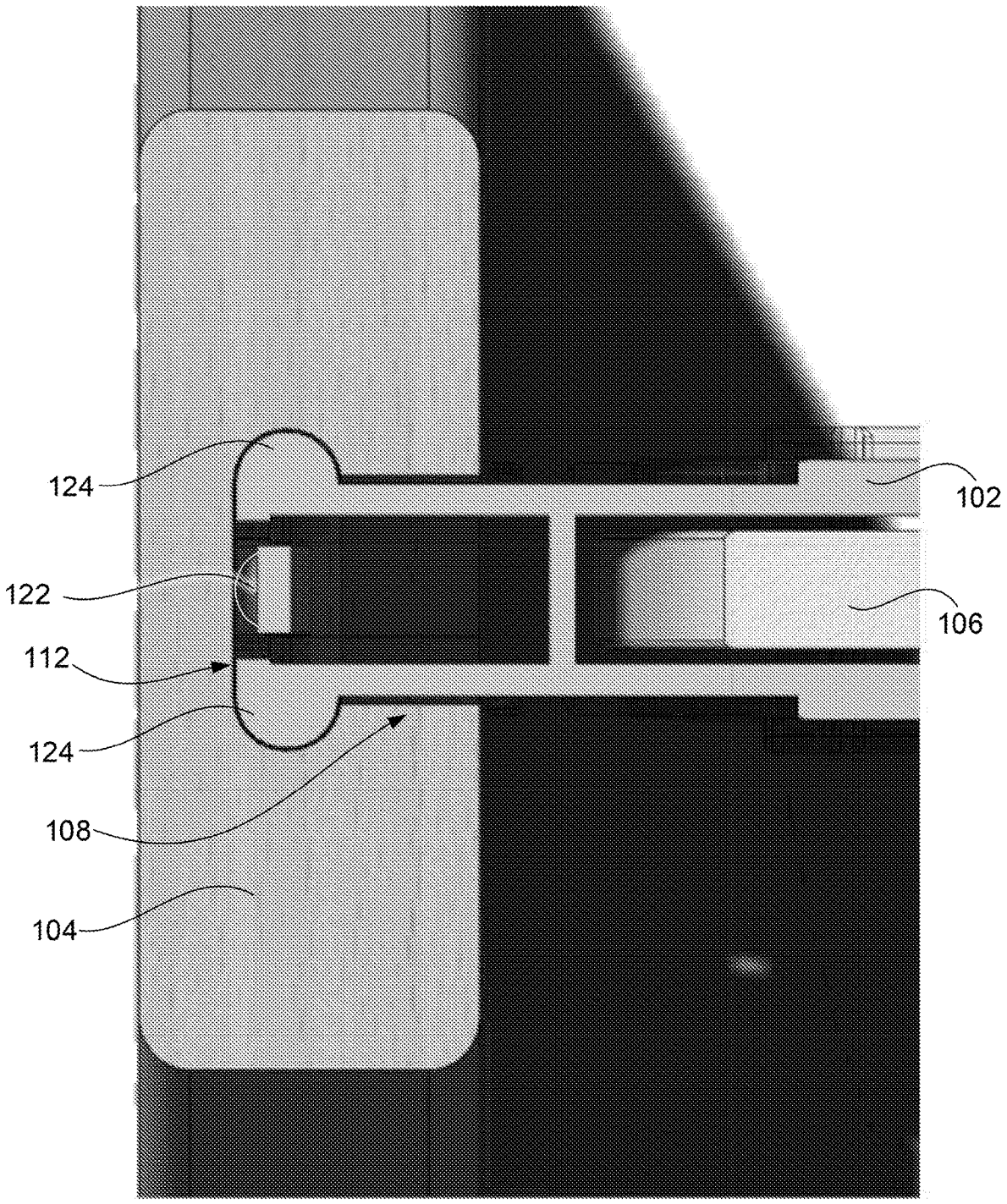
FIG. 11 is a transverse, cross-sectional view of the separable assembly of FIG. 1 before the rigid plastic member engages with cellulose member.
Figure 12:
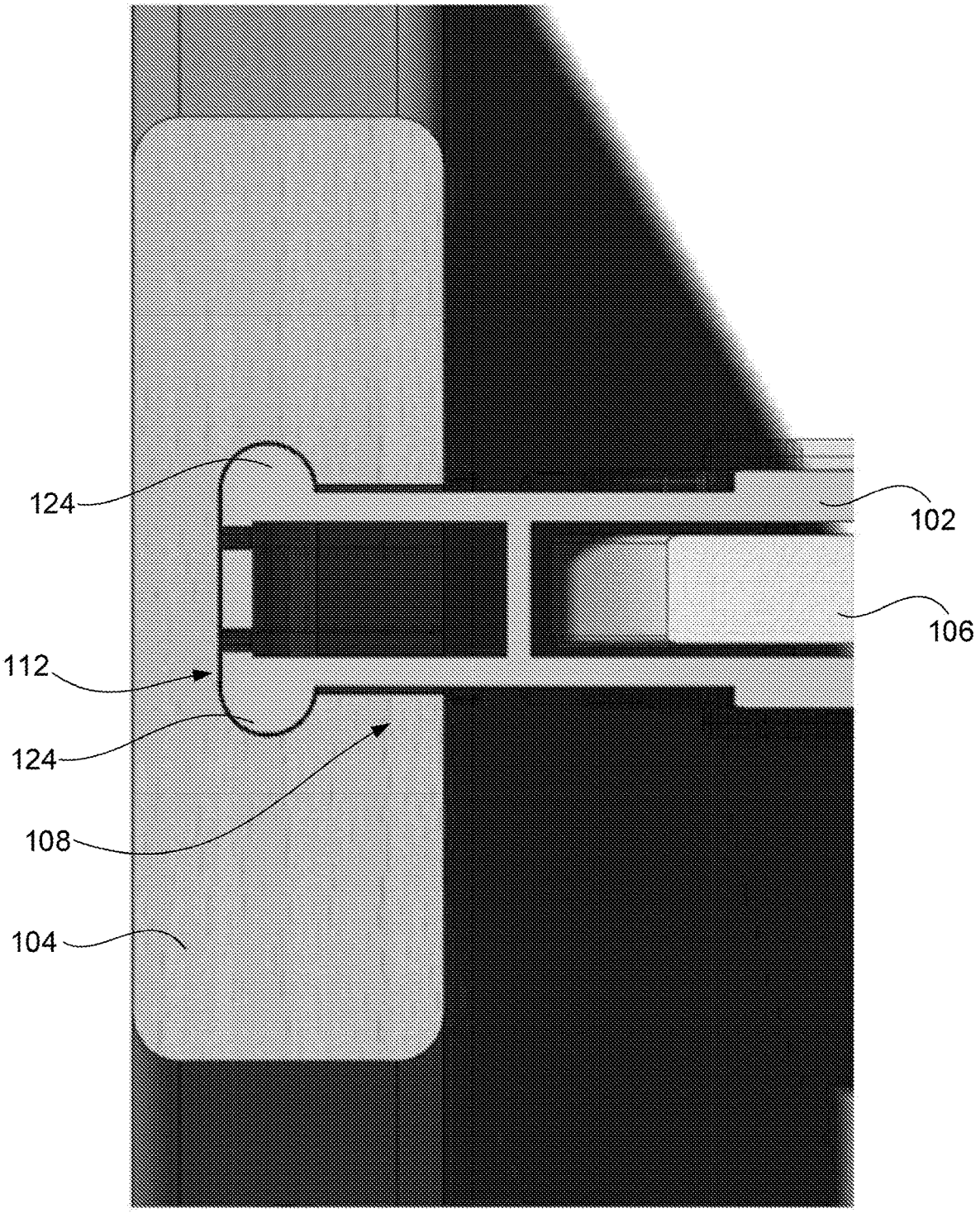
FIG. 12 is a transverse, cross-sectional view of the separable assembly of FIG. 1 after the rigid plastic member engages with cellulose member.

FIG. 10 shows the separable assembly 100 in an assembled state with detent protrusion 122 engaging detent recess 114 and recessed corner 126 being received by closed end 144 of sliding track 108. FIG. 11 shows a transverse cross-section of the separable assembly 100 in a disassembled state, having detent protrusion 122 not engaged with the detent recess 114. FIG. 12 shows a transverse cross-section of the separable assembly 100 having detent protrusion 122 engaged with the detent recess 114, thus, at this angle, detent protrusion 122 is no longer visible.

When sufficient force is applied to move the plastic member 102 along the sliding track 108 from a disassembled position toward the closed end 144 of sliding track 108, the detent protrusion 122 is in contact with a surface of sliding track 108 throughout the length of the sliding track 108 until the detent protrusion 122 engages the detent recess 114. The amount of force required to slide the detent protrusion 122 along the sliding track 108 and into the detent recess 114 at an assembled position is sufficient enough to facilitate assembly while simultaneously ensuring the mechanical stress (i.e., the load per unit area) that the surface of the sliding track 108 experiences is minimized. Thus, the detent design described provides enhanced durability of the separable assembly 100 and prevents or minimizes deformation of the surface of the sliding track 108 after prolonged use. The plastic member 102 can have a hardness that is greater than the hardness of the cellulose member 104.

Figure 13:
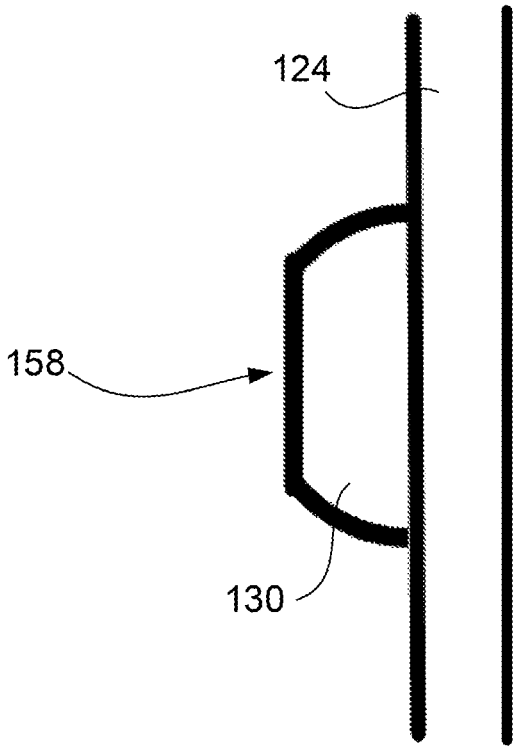
FIG. 13 is a side view of a detent protrusion of the plastic member.

FIG. 13 illustrates an example detent protrusion 130 having a partial hemispherical shape with a planar surface 158 opposite the detent recess 114, when assembled. The planar surface 158 is configured to contact a surface of the detent recess 114 when the detent protrusion 130 engages the detent recess 114. The planar surface 158 typically has a total diameter of about 1.25 mm.

The plastic member 102 has a substantially rectangular shape. In alternative embodiments, the plastic member 102 can have a square or any other suitable shape. The plastic member 102 typically has a total height h of about 192 mm. Furthermore, the plastic member 102 typically has a total width w of about 257 mm. The detent protrusion 122 typically has a total diameter of about 5 mm. The radius of the detent protrusion 122 or the example detent protrusion 130 can be about equal to the radius of the detent recess 114. The spring bridge 134 typically has a total length $l_b$ of about 30 mm and a total width $w_b$ of about 8 mm. Moreover, edges 124 of the plastic member 102 have a length $l_e$ of about 64 mm.

The plastic member 102 is typically made of one or more suitable plastic materials that are rigid (e.g., acrylonitrile butadiene styrene (ABS)). The plastic member 102 is typically manufactured primarily via extrusion, molding, casting, machining, and/or three-dimensional printing.

While a number of examples have been described for illustration purposes, the foregoing description is not intended to limit the scope of the invention, which is defined by the scope of the appended claims. There are and will be other examples and modifications within the scope of the following claims.

What is claimed is:

1. A separable assembly comprising:

a cellulose member having a side surface and an end face forming an edge with the side surface, the cellulose member defining an elongated sliding track therein, the elongated sliding track extending from an end opening at the end face and being of T-shaped transverse cross-section, the cellulose member defining a side opening along the sliding track at the side surface of the cellulose member, the sliding track further defining a detent recess spaced from the end face and extending into the cellulose member; and a rigid plastic member having an edge configured to be received within the end opening of the cellulose member and slid along the sliding track with the plastic member extending through the side opening, the plastic member comprising a detent protrusion configured to engage the detent recess to retain the plastic member at an assembled position along the sliding track, wherein the plastic member comprises a spring bridge extending between two fixed bridge ends spaced apart along the edge, with the detent protrusion extending from the spring bridge at a position between the two bridge ends, the detent protrusion and detent recess being configured such that sufficient force applied to move the plastic member along the sliding track from the assembled position toward the end opening will resiliently deflect the spring bridge to withdraw the detent protrusion from the detent recess.

2. The separable assembly of claim 1, wherein the cellulose member is a leg supporting the rigid plastic member when the separable assembly is assembled.

3. The separable assembly of claim 1, wherein the side opening has an overall width that is about equal to the width of the edge of the plastic member.

4. The separable assembly of claim 1, wherein the sliding track is a recessed slot defined by the cellulose member.

5. The separable assembly of claim 1, wherein the elongated sliding track extends from the end opening at the end face to a closed end.

6. The separable assembly of claim 5, wherein the closed end is curved.

7. The separable assembly of claim 1, wherein the detent recess has a radius of about 1 millimeters (mm) to 7 mm.

8. The separable assembly of claim 1, wherein the plastic member is a board.

9. The separable assembly of claim 1, wherein the plastic member has a hardness that is greater than the hardness of the cellulose member.

10. The separable assembly of claim 1, wherein the plastic member has a height that is greater than the height of the cellulose member.

11. The separable assembly of claim 1, wherein the radius of the detent protrusion is about equal to the radius of the detent recess.

12. The separable assembly of claim 1, wherein the detent protrusion is a partially hemispherical protrusion having a planar surface opposite the detent recess, the planar surface configured to contact a surface of the detent recess when engaging the detent recess.

13. The separable assembly of claim 1, wherein the detent protrusion has a radius of about 1 millimeters (mm) to 7 mm.

14. The separable assembly of claim 1, wherein the detent protrusion is a hemispherical protrusion.

15. The separable assembly of claim 1, wherein the spring bridge has a planar surface opposite the detent recess, the planar surface being coplanar with surfaces of the plastic member adjacent to the bridge ends.

16. The separable assembly of claim 1, wherein the spring bridge has a surface opposite the detent recess that is planar along an entire length of the spring bridge between the two bridge ends.

17. The separable assembly of claim 16, wherein the spring bridge defines a pair of opposing slots extending along the length of the spring bridge between the two bridge ends.

18. The separable assembly of claim 17, wherein the width of each opposing slot is less than the width of the surface of the spring bridge.

19. The separable assembly of claim 1, wherein the deflection of the detent protrusion during disassembly of the separable assembly bows the spring bridge out of its plane.

20. The separable assembly of claim 1, wherein the spring bridge has a length that is less than the length of the edge of the plastic member.

* * * * *